US007040498B2

(12) United States Patent
Rickman et al.

(10) Patent No.: US 7,040,498 B2
(45) Date of Patent: May 9, 2006

(54) WALLBOARD MUD CONTAINER APPARATUS

(76) Inventors: Chandler T. Rickman, 2740 Sewell Mill Rd., Marietta, GA (US) 30062; Brandon P. Rickman, 2546 Octavia La., Marietta, GA (US) 30062

( * ) Notice: Subject to any disclaimer, the term of this patent is extended or adjusted under 35 U.S.C. 154(b) by 0 days.

(21) Appl. No.: 10/196,592

(22) Filed: Jul. 16, 2002

(65) Prior Publication Data

US 2003/0015532 A1 Jan. 23, 2003

Related U.S. Application Data

(60) Provisional application No. 60/305,780, filed on Jul. 17, 2001.

(51) Int. Cl.
*B65D 41/56* (2006.01)

(52) U.S. Cl. ..... 220/42; 220/685; 15/111

(58) Field of Classification Search ..... 220/212, 220/780, 735, 685–702, 570, 571, 571.1, 220/81, 571.11; 15/257.06, 111; 81/490
See application file for complete search history.

(56) References Cited

U.S. PATENT DOCUMENTS

| | | | | | |
|---|---|---|---|---|---|
| 3,079,037 | A | * | 2/1963 | Schechter | 220/212 |
| 3,624,787 | A | * | 11/1971 | Newman | 220/212 |
| 4,164,299 | A | * | 8/1979 | Fuhr | 220/555 |
| 4,266,686 | A | * | 5/1981 | Carter | 220/697 |
| 4,453,646 | A | * | 6/1984 | Harrild | 220/258.5 |
| 4,927,046 | A | * | 5/1990 | Armstrong | 220/697 |
| 5,341,969 | A | * | 8/1994 | Accardo et al. | 222/465.1 |
| 5,419,000 | A | * | 5/1995 | Amato et al. | 15/111 |
| 5,553,701 | A | * | 9/1996 | Jarecki et al. | 206/15.2 |
| 5,603,428 | A | | 2/1997 | Breckwoldt | |
| 5,667,092 | A | | 9/1997 | Julius et al. | |
| 5,738,242 | A | * | 4/1998 | Paris | 220/735 |
| D401,704 | S | * | 11/1998 | Clark | D32/53.1 |
| 5,855,304 | A | | 1/1999 | Dean et al. | |
| 5,913,450 | A | * | 6/1999 | Runkel | 220/696 |
| 6,105,816 | A | | 8/2000 | Shea | |
| 6,138,864 | A | | 10/2000 | Enochs | |
| D457,995 | S | * | 5/2002 | Clark | D32/53.1 |
| 6,485,691 | B1 | * | 11/2002 | Jones | 422/102 |
| 6,513,771 | B1 | * | 2/2003 | Tucker | 248/211 |
| 6,530,500 | B1 | * | 3/2003 | Bravo et al. | 222/143 |
| D481,502 | S | * | 10/2003 | Clark | D32/53.1 |
| 6,681,952 | B1 | * | 1/2004 | Mowe | 220/697 |

FOREIGN PATENT DOCUMENTS

| | | | | |
|---|---|---|---|---|
| DE | 19815364 | * | 9/1999 | 220/735 |
| JP | 4-239454 | * | 8/1992 | 220/735 |
| JP | 11-49172 | * | 2/1999 | 220/735 |

* cited by examiner

*Primary Examiner*—Lien M. Ngo

(57) ABSTRACT

A container apparatus, for storing sheetrock mud, includes a lid portion and a container portion attached to the bottom of the lid portion by an air-tight seal. The container portion includes a floor portion and wall portions projecting upward from the floor portion. The lid portion is attached to top portions of the wall portions. The floor portion includes four straight floor sides which form a rectangle, and four planar trapezoid-shaped wall portions project upward from the four straight floor sides. Preferably, the four planar wall portions slope outwardly from the four straight floor sides. The lid portion includes a snap-fit connection with the container portion. The scraper member has a length which is at least as long as a sheetrock blade and, when the lid portion is removed from the container portion, can be used for scraping excess sheetrock mud off of a sheetrock blade.

7 Claims, 6 Drawing Sheets

FIG 3
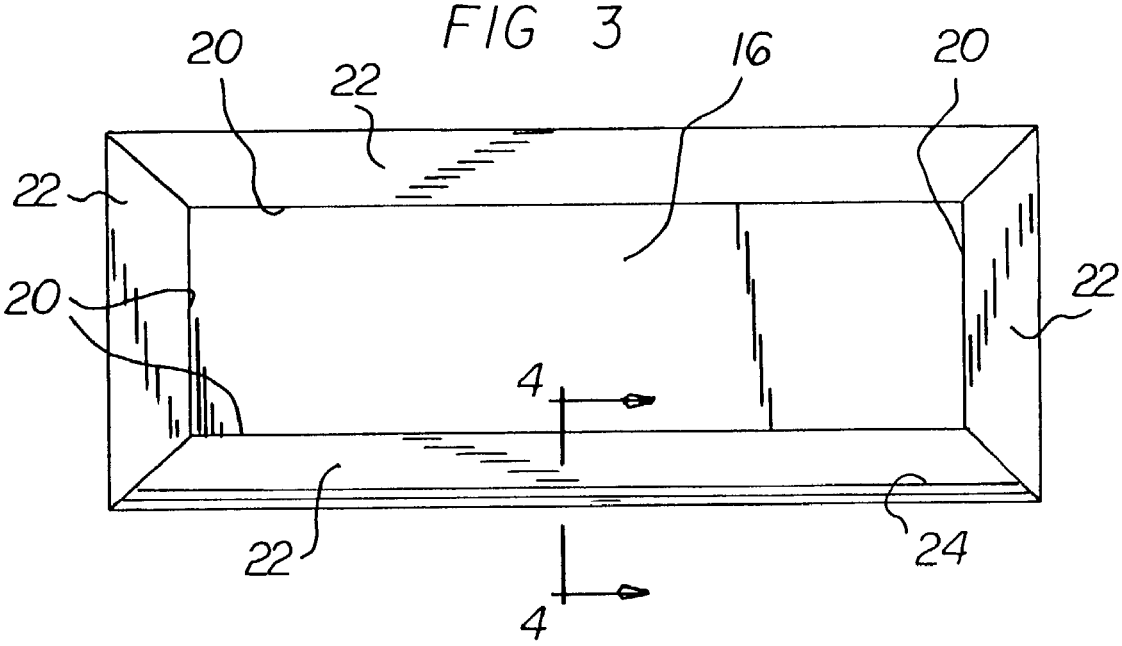
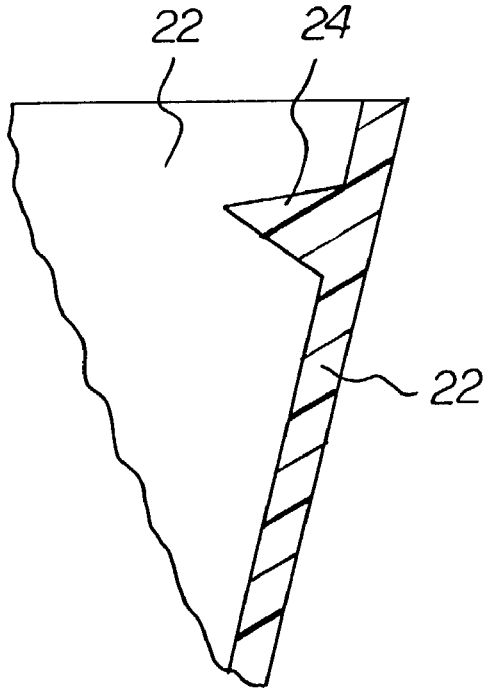
FIG 4

FIG 8
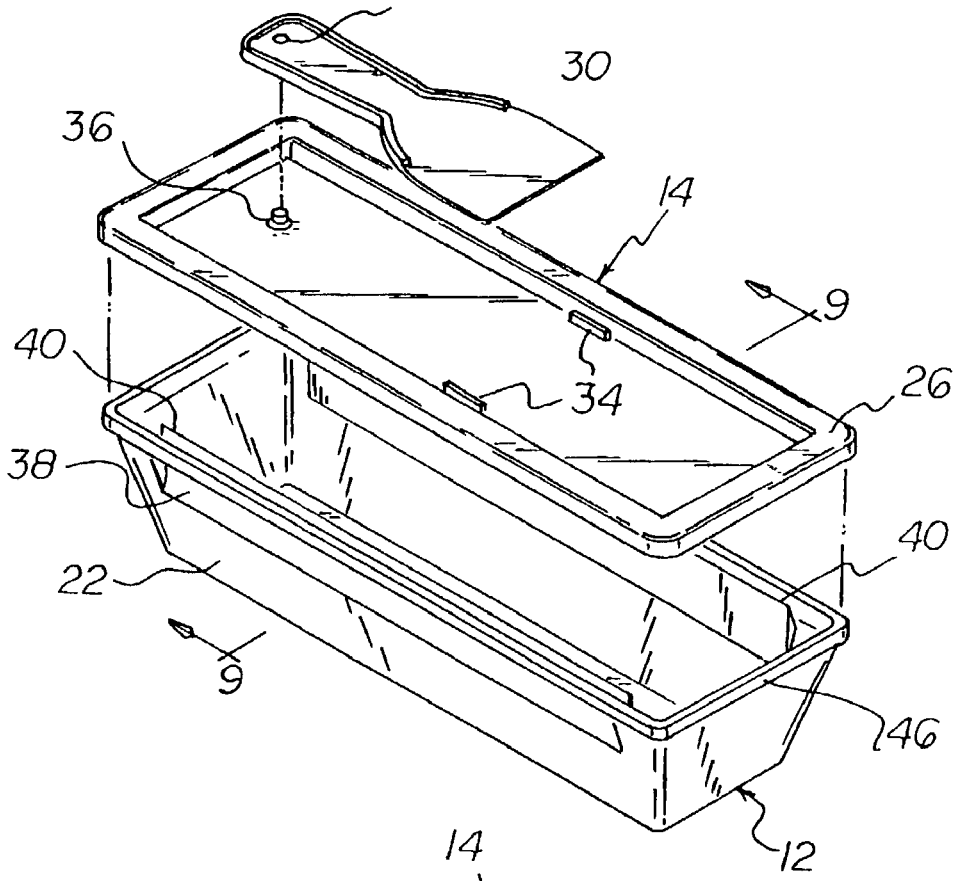
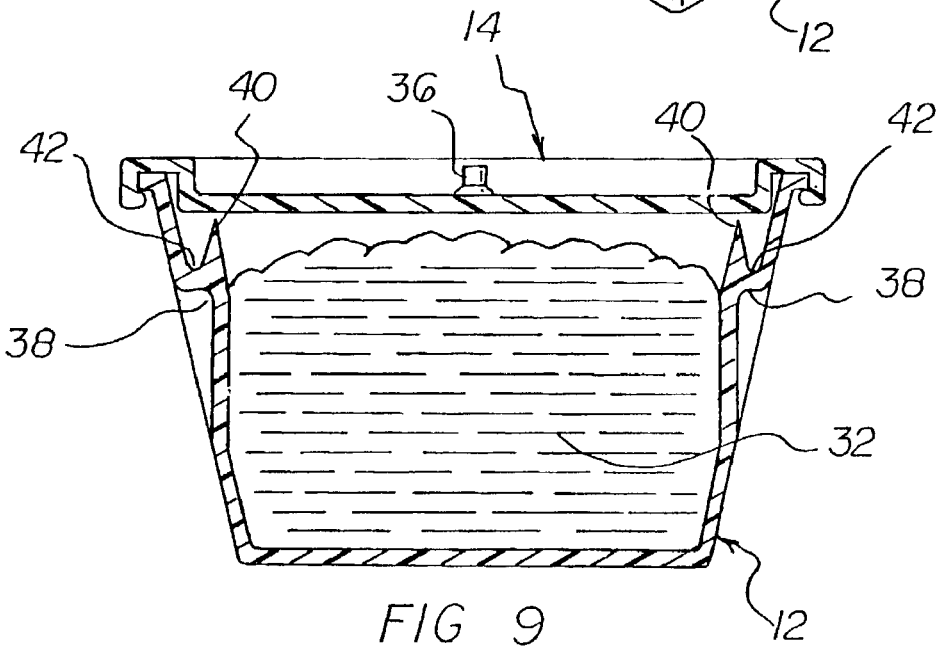
FIG 9

WALLBOARD MUD CONTAINER APPARATUS

CROSS-REFERENCE TO RELATED APPLICATION

This application claims priority based upon my copending Provisional Application Ser. No. 60/305,780; filed Jul. 17, 2001.

BACKGROUND OF THE INVENTION

1. Field of the Invention

The present invention relates generally to containers, and more particularly, to containers especially adapted for holding sheetrock mud or the like.

2. Description of the Prior Art

The use of containers especially adapted for holding sheetrock mud and like materials is well known in the art. Also, other containers of more general design can be used for holding sheetrock mud and the like. In this respect, throughout the years, a number of innovations have been developed relating to such containers, and the following U.S. patents are representative of some of those innovations: U.S. Pat. Nos. 5,603,428, 5,667,092, 5,855,304, 6,105,816, and 6,138,864.

More specifically, U.S. Pat. No. 5,603,428 discloses a joint compound container that has hand grip portion located at the bottom of the container. Since the center of gravity of such a container is located above the bottom-mounted hand grip, the stability of the container with respect to tipping over is compromised. In this respect, it would be desirable if a container for holding sheetrock mud and the like were provided which has hand grip portions located above the bottom of the container.

U.S. Pat. No. 5,667,092 discloses a container which as a bottom container portion and a top lid portion. However, no provision is made for scraping an implement, such as a sheetrock knife, that can be used for applying and smoothing sheetrock mud onto a sheetrock surface. In this respect, for purposes of convenience, it would be desirable to provide a container which includes a structure that is especially designed for scraping sheetrock mud and the like off of a sheetrock knife.

U.S. Pat. No. 5,855,304 discloses a paint can that has container portion and a lid portion. Customarily a wet paint brush is wiped on the top rim of the container portion. When this is done, paint is interposed between the lid and the container. When dried, such paint often forms an adhesive bond between the lid and the container. In another context, in scraping sheetrock mud off of a sheetrock knife, it is desirable to provide a container that permits scraping of the sheetrock knife inside the container itself, so that sheetrock mud is not trapped between the top rim of the container and the lid to form an adhesive bond between the top rim of the container and the lid.

U.S. Pat. No. 6,105,816 discloses a painter's aid that includes a portion for scraping a paintbrush, wherein the scraping portion is located above the top rim of a lower container. Just as discussed with respect to U.S. Pat. No. 5,855,304 discussed above, this patent does not disclose a structure inside the container for scraping paint off of a paintbrush.

U.S. Pat. No. 6,138,864 discloses a utility closure for a mud bucket. This device provides for holding a tool along side the bucket. To hold the tool along the side of the bucket, a securing device is employed that encircles the bucket. To avoid the use of such a bucket-encircling device, and for purposes of simplicity, it would be desirable if a sheetrock mud container were provided that includes means for securing a sheetrock knife that are located on the top of the lid of the device.

Still other features would be desirable in a sheetrock mud container apparatus. For example, most commonly, all the necessary tools for repairing sheetrock are sold separately. That is, the sheetrock mud, the mud container with knife scraper, and the sheetrock knife are sold separately. In this respect, it would be desirable to provide an apparatus which provides all the necessary tools in one package for repairing sheetrock. That is, it would be desirable to provide a single package in which the sheetrock mud, the mud container with knife scraper, and the sheetrock knife are sold as a single combination product.

The current method of sheetrock mud clean-up requires a person to remove the sheetrock mud from the container and place it in a round bucket, purchased separately. Then, the container must be washed out for future use. The sheetrock knife must also be cleaned and stored separately. In this respect, it would be desirable to reduce clean-up time by attaching an airtight lid onto the container, by simply wiping off the sheetrock knife, and by attaching it to the lid for storage.

When separate items that are used in a sheetrock mud operation have to be gathered from separate locations and brought together at a single location, there is often a significant amount of time spent gathering and assembling the separate items. This is especially true when one or more of such items have been lost or misplaced during storage. In this respect, it would be desirable to provide an apparatus that eliminates time spent looking for separate item which may have been lost or misplaced during storage.

Thus, while the foregoing body of prior art indicates it to be well known to use containers for storing sheetrock mud, the prior art described above does not teach or suggest a sheetrock mud container apparatus which has the following combination of desirable features: (1) has hand grip portions located above the bottom of the container; (2) provides a container which includes a structure that is especially designed for scraping sheetrock mud and the like off of a sheetrock knife; (3) provides a container that permits scraping of the sheetrock knife inside the container itself, so that sheetrock mud is not trapped between the top rim of the container and the lid to form an adhesive bond between the top rim of the container and the lid; (4) includes means for securing a sheetrock knife that are located on the top of the lid of the device; (5) provides an apparatus having all the necessary tools in one package for repairing sheetrock; (6) provides a single package in which the sheetrock mud, the mud container with knife scraper, and the sheetrock knife are sold as a single combination product; (7) reduces clean-up time by attaching an airtight lid onto the container, by simply wiping off the sheetrock knife, and by attaching it to the lid for storage; and (8) eliminates time spent looking for separate items which may have been lost or misplaced during storage. The foregoing desired characteristics are provided by the unique sheetrock mud container apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a container apparatus which includes a lid portion and a container portion attached to the bottom of the lid portion. The container portion includes a floor portion and wall portions projecting upward from the floor portion. The lid portion is attached to top portions of the wall portions. The floor portion includes at least one straight floor side, and at least one planar wall portion projects upward from the at least one straight floor side. A straight scraper member projects horizontally inward from the at least one planar wall portion. The at least one planar wall portion slopes outward from the straight floor side.

Preferably, the floor portion includes four straight floor sides, and, preferably, four planar wall portions project upward from the four straight floor sides. Preferably, the four planar wall portions slope outwardly from the four straight floor sides. Preferably, the four straight floor sides form a rectangle. Preferably, each of the four planar wall portions is trapezoidal shaped.

The lid portion includes a snap-fit connection with the container portion. Preferably, the snap-fit connection is in a form of a snap-fit lid frame formed on the periphery of the lid portion. The snap-fit lid frame can include snap-fit grooves that receive top edges of the planar wall portions. The scraper member has a length which is at least as long as a sheetrock blade.

The container apparatus of the invention can be used for retaining a quantity of sheetrock mud, and the scraper member can be used for scraping excess sheetrock mud off of a sheetrock blade. Unused sheetrock mud can be stored in the container portion by virtue of an air-tight seal between the container portion and the lid portion.

In accordance with another aspect of the invention, the lid portion includes knife handle holding clips for receiving and holding a sheetrock knife by its handle. The container portion includes a pre-loaded quantity of sheetrock mud. A sheetrock knife can be attached to the lid portion.

In accordance with another aspect of the invention, a portion of the straight scraper member projects horizontally inward from the at least one planar wall portion and a portion projects vertically upward and substantially parallel to the at least one planar wall portion.

The horizontally and vertically projecting scraper member is in a form of a vertically-extending straight scraper member. A bottom portion of the vertically-extending straight scraper member includes a scraper well. Each of the planar wall portions includes a concave hand grip channel. The concave hand grip channels are located above the bottom of the container portion.

A scraper-well/handle-channel common wall exists between the bottom of the scraper well and the top of the concave hand grip channel. The thickness of the scraper-well/handle-channel common wall is substantially equal to the thickness of the at least one planar wall portion.

The lid portion includes knife blade holding clips and a knife handle holding protuberance for receiving and holding a sheetrock knife. The container portion includes a snap-fit top lip for reception in the snap-fit lid frame of the lid portion.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining at least three preferred embodiments of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved sheetrock mud container apparatus which has all of the advantages of the prior art and none of the disadvantages.

It is another object of the present invention to provide a new and improved sheetrock mud container apparatus which may be easily and efficiently manufactured and marketed.

It is a further object of the present invention to provide a new and improved sheetrock mud container apparatus which is of durable and reliable construction.

An even further object of the present invention is to provide a new and improved sheetrock mud container apparatus which is susceptible of a low cost of manufacture with regard to both materials and labor, and which accordingly is then susceptible of low prices of sale to the consuming public, thereby making such sheetrock mud container apparatus available to the buying public.

Still yet a further object of the present invention is to provide a new and improved sheetrock mud container apparatus which has hand grip portions located above the bottom of the container.

Still another object of the present invention is to provide a new and improved sheetrock mud container apparatus that provides a container which includes a structure that is especially designed for scraping sheetrock mud and the like off of a sheetrock knife.

Yet another object of the present invention is to provide a new and improved sheetrock mud container apparatus which provides a container that permits scraping of the sheetrock knife inside the container itself, so that sheetrock mud is not trapped between the top rim of the container and the lid to form an adhesive bond between the top rim of the container and the lid.

Even another object of the present invention is to provide a new and improved sheetrock mud container apparatus that includes means for securing a sheetrock knife that are located on the top of the lid of the device.

Yet another object of the present invention is to provide a new and improved sheetrock mud container apparatus that provides an apparatus having all the necessary tools in one package for repairing sheetrock.

Still a further object of the present invention is to provide a new and improved sheetrock mud container apparatus that provides a single package in which the sheetrock mud, the mud container with knife scraper, and the sheetrock knife are sold as a single combination product.

Yet another object of the present invention is to provide a new and improved sheetrock mud container apparatus which reduces clean-up time by attaching an airtight lid onto the container, by simply wiping off the sheetrock knife, and by attaching it to the lid for storage.

Still a further object of the present invention is to provide a new and improved sheetrock mud container apparatus that eliminates time spent looking for separate items which may have been lost or misplaced during storage.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein:

FIG. 3 is a top view of the container portion of FIG. 2 taken along line 3—3 thereof.

FIG. 4 is an enlarged cross-sectional view of the portion of the embodiment of the invention shown in FIG. 3 taken along line 4—4 thereof.

FIG. 8 is a perspective view of a third embodiment of the invention wherein the lid portion includes knife blade holding clips and a knife handle holding protuberance for holding a sheetrock knife, wherein the container portion includes concave hand grip channels, wherein vertically-extending straight scraper members are provided, and wherein a scraper-well/handle-channel common wall exists between the bottom of the scraper well and the top of the concave hand grip channel.

FIG. 9 is a cross-sectional view of the embodiment of the invention of FIG. 8 taken along line 9—9 thereof.

DESCRIPTION OF THE PREFERRED EMBODIMENT

Figure 1:
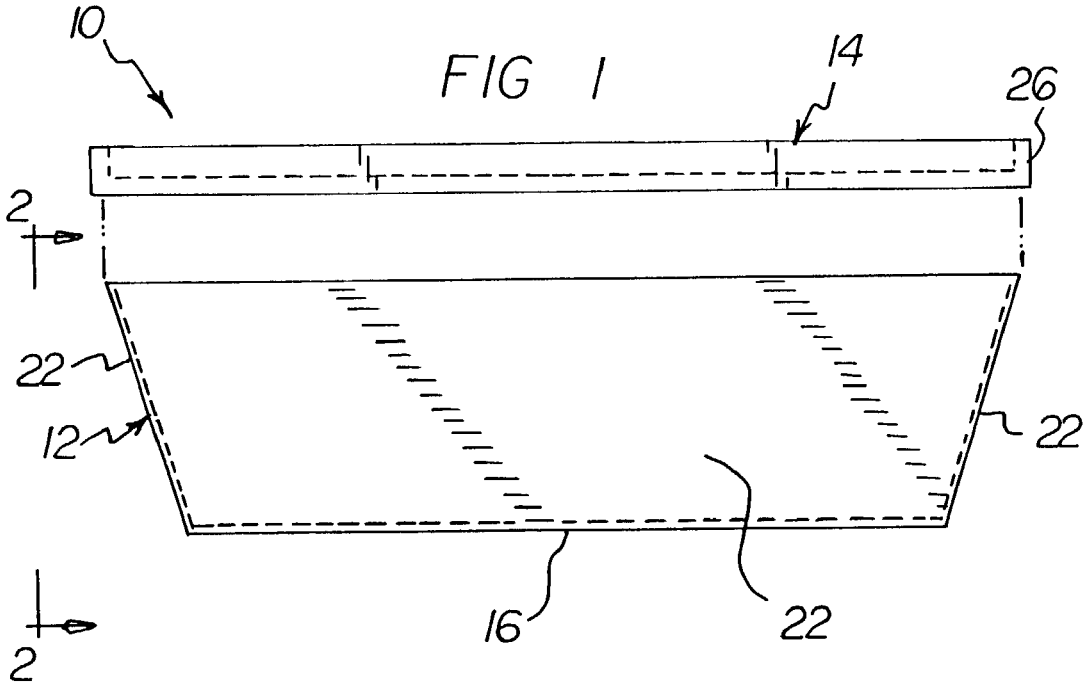
FIG. 1 is a side view showing a first embodiment of the sheetrock mud container apparatus of the invention, with the lid portion shown separated from the body portion of the apparatus.
Figure 2:
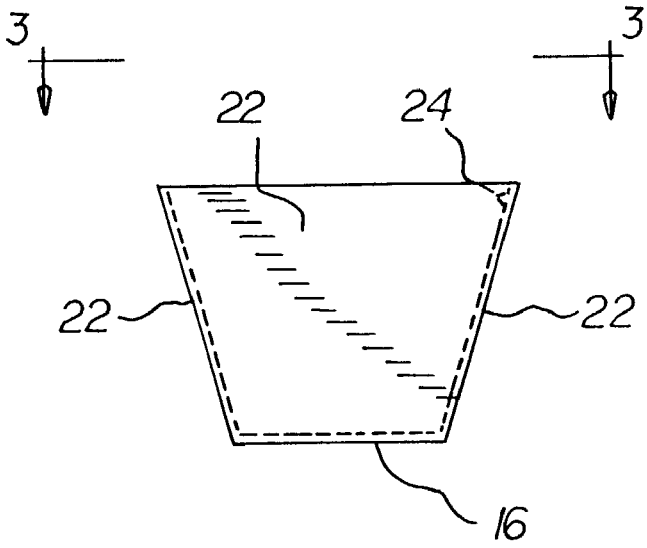
FIG. 2 is an end view of the container portion of the invention shown in FIG. 1 taken along line 2—2 of FIG. 1.
Figure 5:
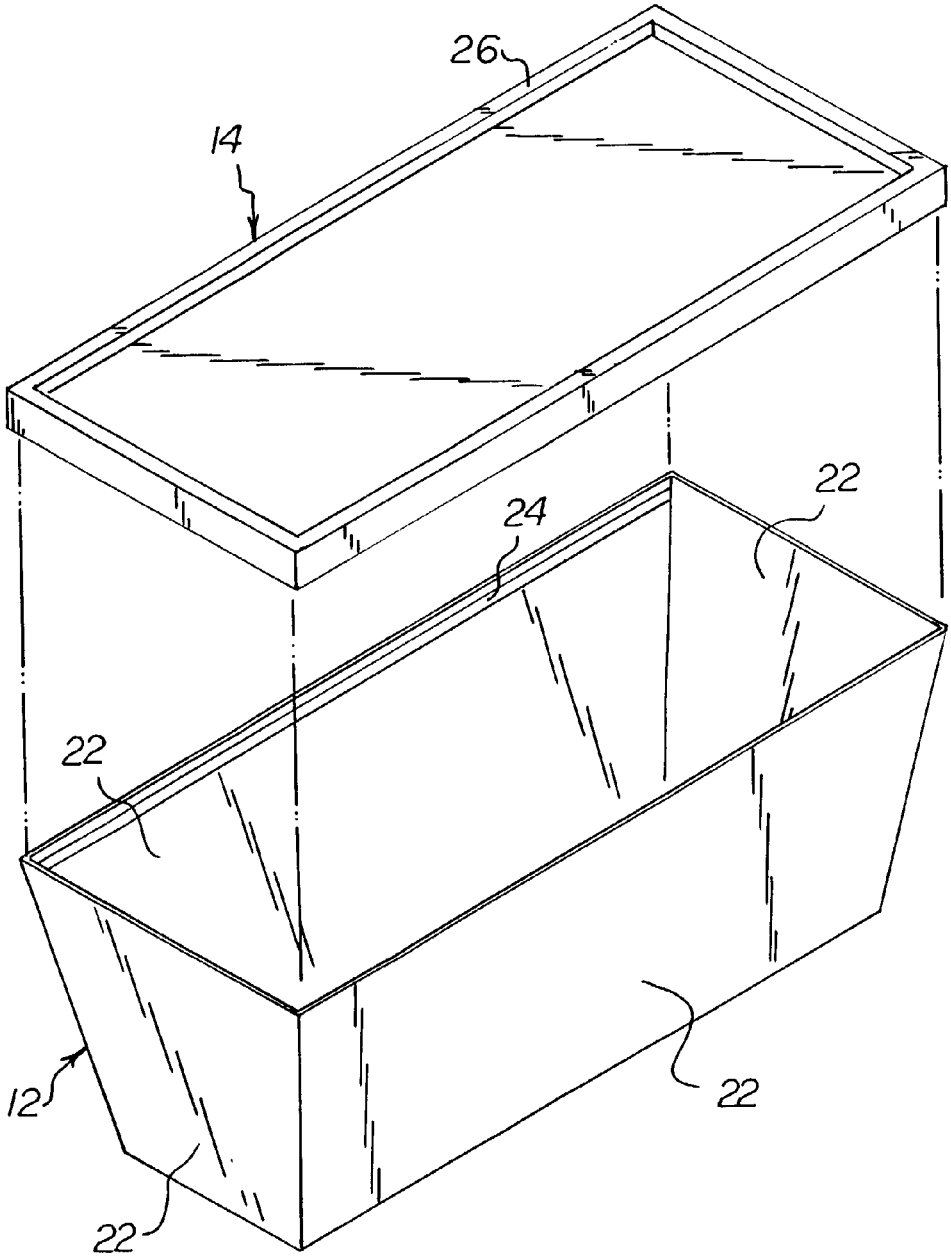
FIG. 5 is a perspective view showing the embodiment of the invention shown in FIGS. 1–4, with the lid portion shown separated from the body portion of the apparatus.

With reference to the drawings, a new and improved sheetrock mud container apparatus embodying the principles and concepts of the present invention will be described.

Turning to FIGS. 1–5, there is shown a first embodiment of the sheetrock mud container apparatus of the invention generally designated by reference numeral 10. In the first embodiment, a sheetrock mud container apparatus 10 includes a lid portion 14 and a container portion 12 attached to the bottom of the lid portion 14. The container portion 12 includes a floor portion 16 and wall portions projecting upward from the floor portion 16. The lid portion 14 is attached to top portions of the wall portions. The floor portion 16 includes at least one straight floor side 20, and at least one planar wall portion 22 projects upward from the at least one straight floor side 20. A straight scraper member 24 projects horizontally inward from the at least one planar wall portion 22. The at least one planar wall portion 22 slopes outward from the straight floor side 20.

Preferably, the floor portion 16 includes four straight floor sides 20, and, preferably, four planar wall portions 22 project upward from the four straight floor sides 20. Preferably, the four planar wall portions 22 slope outwardly from the four straight floor sides 20. Preferably, the four straight floor sides 20 form a rectangle. Preferably, each of the four planar wall portions 22 is trapezoidal shaped.

The lid portion 14 includes a snap-fit connection with the container portion 12. Preferably, the snap-fit connection is in a form of a snap-fit lid frame 26 formed on the periphery of the lid portion 14. The snap-fit lid frame 26 can include snap-fit grooves that receive top edges of the planar wall portions 22. In accordance with the invention, the snap-fitment contemplated is suitable to maintain an air-tight seal between the lid and the container. The scraper member 24 has a length which is at least as long as a sheetrock blade.

To use the container apparatus 10 of the invention, the lid portion 14 is removed from the container portion 12. Preferably, a quantity of sheetrock mud or wallboard mud (not shown) is placed in the container portion 12. A sheetrock blade (not shown) is used to scoop out some of the sheetrock mud, and the sheetrock blade is scraped up against the scraper member 24 to clean excess sheetrock mud off of the sheetrock blade.

When a quantity of sheetrock mud remains in the container portion 12, and when no more sheetrock mud is needed for a period of time, the snap-fit lid frame 26 of the lid portion 14 is snap fitted onto the tops of the planar wall portions 22 in a substantially air-tight manner. In this way, the sheetrock mud that remains in the container portion 12 is prevented from drying out.

Figure 6:
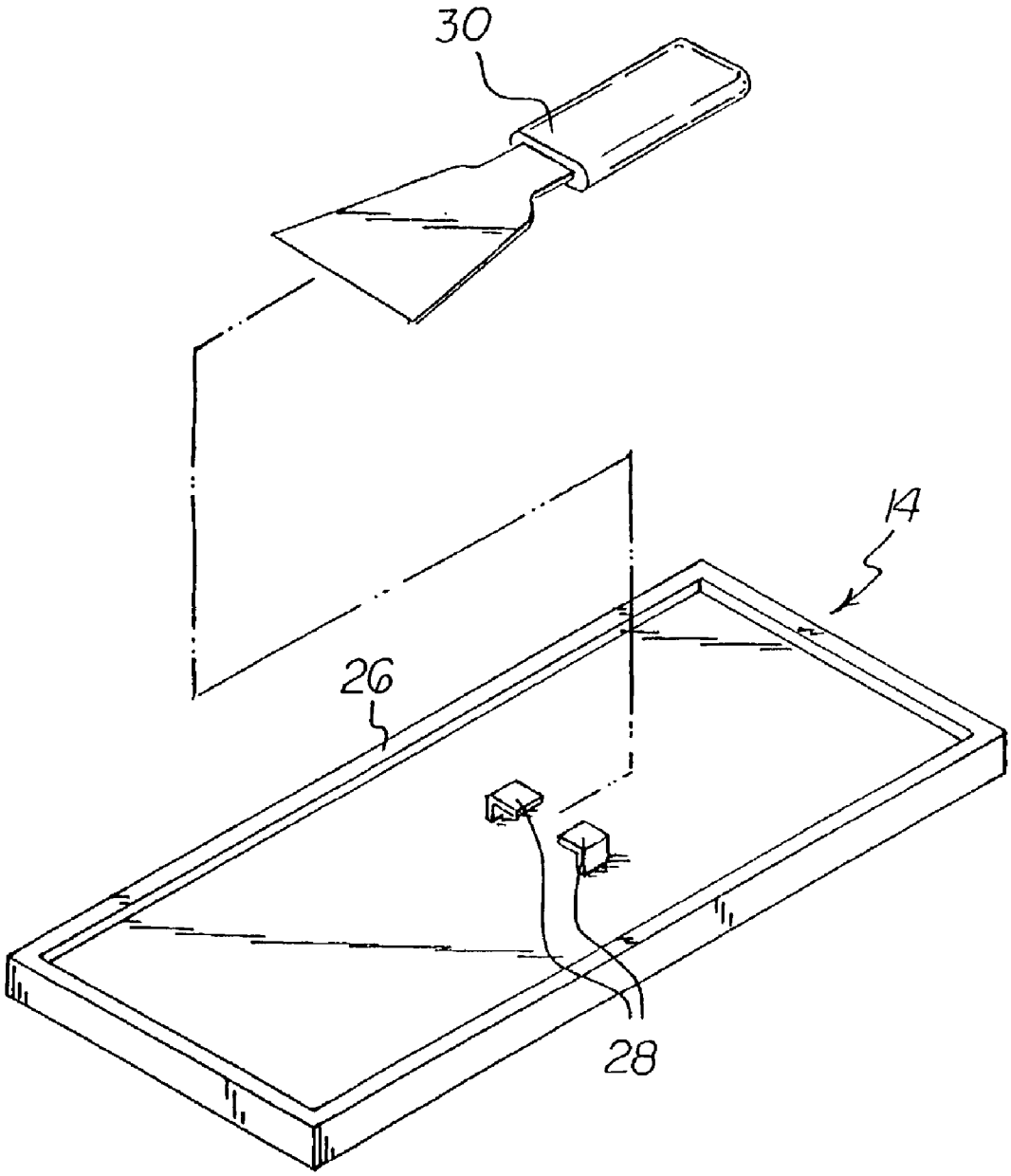
FIG. 6 is a partially exploded perspective view of a lid portion of a second embodiment of the invention which includes knife handle holding clips for holding a sheetrock knife by its handle.
Figure 7:
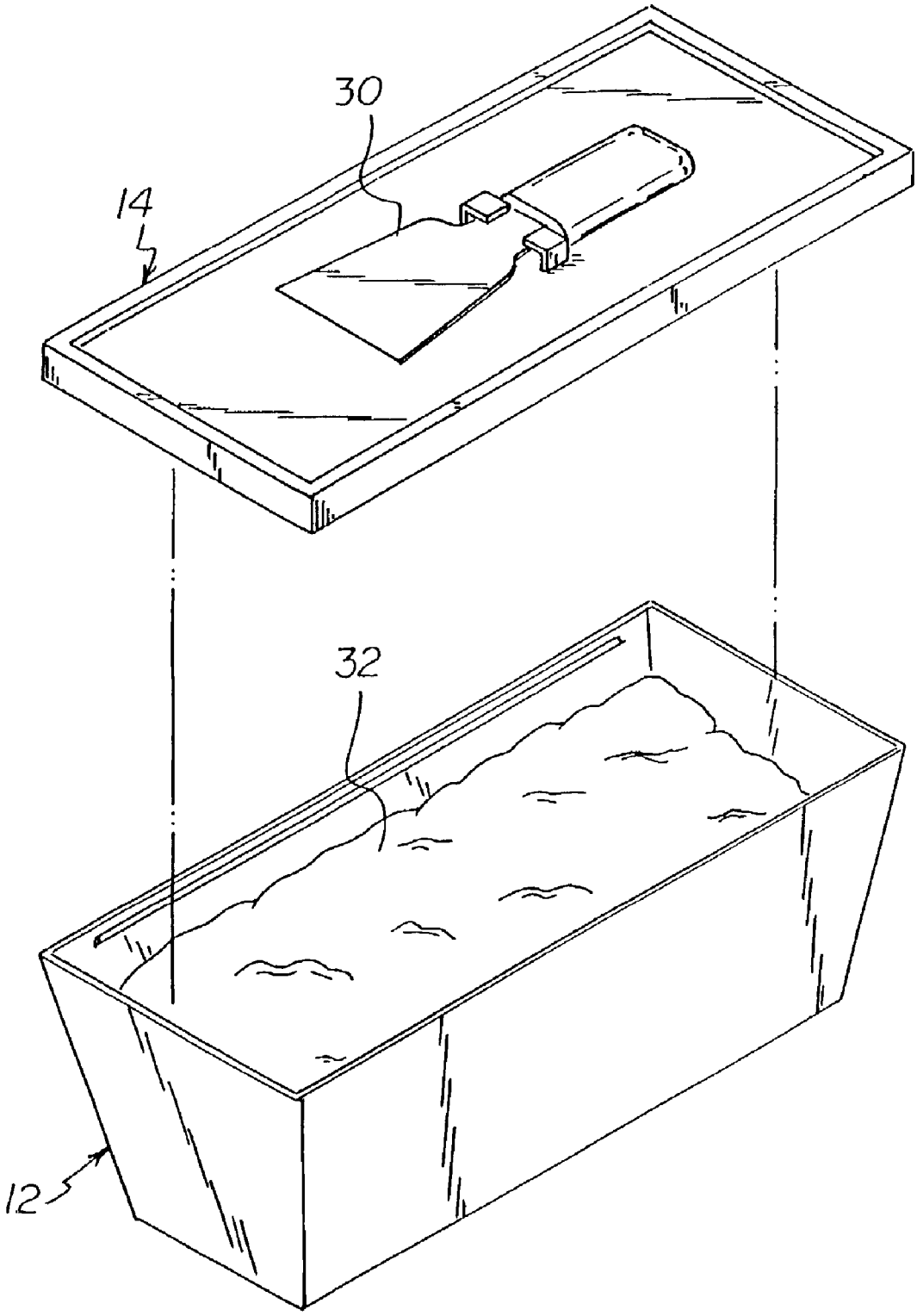
FIG. 7 is a perspective view of the lid portion of FIG. 6 separated from the container portion which contains a quantity of sheetrock mud.

Turning to FIGS. 6 and 7, a second embodiment of the invention is shown. Reference numerals are shown that correspond to like reference numerals that designate like elements shown in the other figures. In addition, the lid portion 14 includes knife handle holding clips 28 for receiving and holding a sheetrock knife 30 by its handle. A sheetrock knife 30 can be attached to the lid portion 14. The container portion 12 includes a pre-loaded quantity of sheetrock mud 32.

Turning to FIGS. 8 and 9, a third embodiment of the invention is shown. Reference numerals are shown that correspond to like reference numerals that designate like elements shown in the other figures. In addition, a portion of the straight scraper member projects horizontally inward from the at least one planar wall portion 22 and a portion projects vertically upward and substantially parallel to the at least one planar wall portion 22.

The horizontally and vertically projecting scraper member is in a form of a vertically-extending straight scraper member 40. A bottom portion of the vertically-extending straight scraper member 40 includes a scraper well. Each of the planar wall portions 22 includes a concave hand grip channel 38. The concave hand grip channels 38 are located above the bottom of the container portion 12. As a result, the container is grasped above the center of gravity of such a container adding stability to the container with respect to tipping over.

A scraper-well/handle-channel common wall 42 exists between the bottom of the scraper well and the top of the concave hand grip channel 38. The thickness of the scraper-well/handle-channel common wall 42 is substantially equal to the thickness of the at least one planar wall portion 22. With the thickness of the scraper-well/handle-channel common wall 42 being substantially equal to the thickness of the planar wall portions 22, when the container portion 12 is produced by a molding process, a uniform rate of cure can be accomplished for the vertically-extending straight scraper member 40, the scraper-well/handle-channel common wall 42, and the planar wall portions 22.

The lid portion 14 includes knife blade holding clips 34 and a knife handle holding protuberance 36 for receiving and holding a sheetrock knife 30. The sheetrock knife 30 has a protuberance reception channel 44 for receiving the knife handle holding protuberance 36. The container portion 12 includes a snap-fit top lip 46 for reception in the snap-fit lid frame 26 of the lid portion 14.

To use the lid portion 14 in FIGS. 6 and 7, the handle of the sheetrock knife 30 is locked onto the lid portion 14 by engaging the handle of the sheetrock knife 30 with the knife handle holding clips 28 on the lid portion 14.

To use the lid portion 14 in FIG. 8, the blade of the sheetrock knife 30 is engaged with the knife blade holding clips 34, and the protuberance reception channel 44 in the handle of the sheetrock knife 30 is engaged with the knife handle holding protuberance 36.

With the embodiment of the invention shown in FIGS. 8 and 9, the lid portion 14 is fitted onto the container portion 12 by engaging the snap-fit lid frame 26 with the snap-fit top lip 46. This snap-fit engagement provides a substantially air tight seal between the lid portion 14 and the container portion 12, whereby the pre-loaded quantity of sheetrock mud 32 inside the container portion 12 is prevented from drying out by evaporation. This is important both before and after use of the mud to prevent the mud from drying out when inside the container portion 12. The apparatus can be easily picked up and held by a person placing one's fingers in the concave hand grip channels 38.

Without limiting the present invention, and merely as a further illustration thereof, the container portion 12 may have the following preferred dimensions: length (at the top)=14 inches; height=3.25 inches; width (at the top) =4.625 inches; length (at the bottom)=12 inches; and width (at the bottom)=2 inches.

The components of the sheetrock mud container apparatus of the invention can be made from inexpensive and durable metal and plastic materials. When the apparatus is made from transparent plastic materials, one can easily see the contents inside the apparatus without removing the lid portion.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved sheetrock mud container apparatus that is low in cost, relatively simple in design and operation, and which may advantageously be used by having hand grip portions located above the bottom of the container. With the invention, a sheetrock mud container apparatus provides a container which includes a structure that is especially designed for scraping sheetrock mud and the like off of a sheetrock knife. With the invention, a sheetrock mud container apparatus provides a container that permits scraping of the sheetrock knife inside the container itself, so that sheetrock mud is not trapped between the top rim of the container and the lid to form an adhesive bond between the top rim of the container and the lid. With the invention, a sheetrock mud container apparatus is provided which includes means for securing a sheetrock knife that are located on the top of the lid of the device. With the invention, a sheetrock mud container apparatus provides an apparatus having all the necessary tools in one package for repairing sheetrock. With the invention, a sheetrock mud container apparatus provides a single package in which the sheetrock mud, the mud container with knife scraper, and the sheetrock knife are sold as a single combination product. With the invention, a sheetrock mud container apparatus is provided which reduces clean-up time by attaching an airtight lid onto the container, by simply wiping off the sheetrock knife, and by attaching it to the lid for storage. With the invention, a sheetrock mud container apparatus is provided which eliminates time spent looking for separate items which may have been lost or misplaced during storage.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as to encompass all such modifications as well as all relationships equivalent to those illustrated in the drawings and described in the specification.

Finally, it will be appreciated that the purpose of the annexed Abstract is to enable the U.S. patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

The invention claimed is:

1. A wallboard mud container apparatus, comprising:

a lid portion, a container portion attached to the bottom of said lid portion, wherein said container portion includes a floor portion and an annular wall portion projecting upward from said floor portion, wherein said lid portion is adapted to be attached to top portions of said annular wall portion, wherein said lid portion includes a snap-fit connection with said container portion, wherein said snap-fit connection is in a form of a snap-fit lid frame formed of the periphery of said lid portion, wherein said snap-fit lid frame is adapted to receive top edges of said annular wall portion to form an air-tight seal with said top edges of said annular wall portion, and wherein said lid portion defines a portion peripherally surrounded by said snap-lid frame to define a receptacle for a wallboard mud knife adapted to lie within said receptacle, and means for removably securing said wallboard mud knife in disposition within said receptacle, wherein said portion peripherally surrounded by said snap-lid frame is recessed below said snap-fit lid frame such that said wallboard mud knife is adapted to lie flush with respect to said snap-lid frame when said knife is removably secured by said means in disposition within said receptacle, and said apparatus further including:

a pre-loaded quantity of wallboard mud in said container portion.

2. The apparatus of claim 1 wherein said means for removably securing said wallboard mud knife includes at least one knife handle holding clip for receiving and holding a wallboard mud knife by its handle.

3. The apparatus of claim 1 wherein said means for removably securing said knife includes knife blade holding clips and a knife handle holding protuberance for receiving and holding a wallboard mud knife.

4. The apparatus of claim 1 wherein said snap-lid frame defines an annular groove on the underside thereof for receiving the top edge portions of said annular wall.

5. The apparatus of claim 1 further including a scraper member projecting upwardly from said annular wall portion within said container portion proximal to a top portion of said annular wall portion.

6. The apparatus of claim 5 wherein said scraper member defines a substantially straight edge having a length equal to at least the width of the blade of said wallboard mud knife.

7. The apparatus of claim 6 wherein said straight scraper member edge projects horizontally inward from the interior surface of said annular wall portion and at least a portion of said scraper member edge projects vertically upward and substantially parallel to said interior surface of said annular wall portion.

* * * * *